US008226322B2

(12) United States Patent
Blair

(10) Patent No.: US 8,226,322 B2
(45) Date of Patent: Jul. 24, 2012

(54) TRAFFIC BARRIER POP-UP BOLLARD SYSTEM

(76) Inventor: Joey W. Blair, Panama City, FL (US)

( * ) Notice: Subject to any disclaimer, the term of this patent is extended or adjusted under 35 U.S.C. 154(b) by 82 days.

(21) Appl. No.: 12/927,890

(22) Filed: Nov. 29, 2010

(65) Prior Publication Data

US 2012/0134745 A1 May 31, 2012

(51) Int. Cl.
*E01F 15/00* (2006.01)
*E01F 13/04* (2006.01)
*E01F 9/011* (2006.01)

(52) U.S. Cl. ..... 404/11; 404/6

(58) Field of Classification Search ..... 404/6, 9, 404/11; 256/13.1
See application file for complete search history.

(56) References Cited

U.S. PATENT DOCUMENTS 2,053,999 A * 9/1936 Moore ..... 404/11
4,624,600 A 11/1986 Wagner et al.
4,705,426 A 11/1987 Peree
5,146,710 A 9/1992 Caldwell
5,248,215 A 9/1993 Fladung
6,349,503 B1 * 2/2002 Gompertz et al. ..... 49/34
6,485,225 B1 11/2002 Baker
6,702,512 B1 3/2004 Reale
6,997,638 B2 2/2006 Hensley et al.
7,118,304 B2 10/2006 Turpin et al.
7,641,416 B2 1/2010 Miracle

* cited by examiner

*Primary Examiner* — Raymond W Addie
(74) *Attorney, Agent, or Firm* — J. Ronald Richebourg

(57) ABSTRACT

Disclosed is a self-contained, pop-up bollard barrier system (10) that is capable of working from a single electromechanical actuator (29) with a series of belts (30) and pulleys (38, 38A). The system (10) is built in two parts that once the foundation vault (44) is in place, the internal apparatus or bollard assembly (11) can be removed as a unit for maintenance or can be completely replaced with another assembly to have a brand new barrier without the need of replacing or moving any of the initial foundation. The system (10) enhances the ability of the contractor on site to have a self contained product that only needs wiring and requires no grease while minimizing the installation cost, which is passed on to the end user.

20 Claims, 7 Drawing Sheets

TRAFFIC BARRIER POP-UP BOLLARD SYSTEM

FIELD OF THE INVENTION

The present invention generally relates to traffic control barriers, and more specifically to an improved self-contained automatic pop-up bollard system.

BACKGROUND OF THE INVENTION

Traffic control devices are well known. There are numerous examples in the prior art of various devices to control or limit traffic access to restricted areas. Recent terrorist attacks have presented numerous problems for controlling traffic access to highly secured areas. Local, state and federal governments have elevated concerns for securing areas from the threats of terrorists. The military has elevated concerns for securing military bases as well.

Terrorist attacks on embassies, and other sites of foreign governments or corporations have become commonplace. Some of the more notorious attacks have involved terrorists driving large trucks laden with explosives through the gates of an embassy or other secured sites and detonating the explosives. In response to these attacks, many such sites have installed a variety of barriers in front of their gates. However, the barriers installed at these installations also obstruct the passage of authorized vehicles.

Examples of some pertinent prior art patents are listed and discussed below:

U.S. Pat. No. 4,624,600, issued on Nov. 25, 1986 to R. H. Wagner, et al, and entitled ANTI-TERRORIST VEHICLE IMPALER. This patent discloses a barrier device disposed in a trench in a roadway with an impaler arm that pivots into an oncoming vehicle when released by an explosive charge. The impaler arm is secured in place by a trigger that releases by the explosive charge, and a counter weight on the opposite end of the impaler arm. The counterweight is of sufficient mass so that the pivoting impaler arm turns about the pivot under the force of gravity, thereby thrusting the impaler arm above the surface of the roadway. The impaler arm projects at an angle toward a vehicle to be stopped, which is impaled by the arms.

U.S. Pat. No. 4,705,426, issued on Nov. 10, 1987 to B. A. Perea entitled SECURITY AND DEFENSE BARRIER discloses a vault buried within and transverse to the roadway. The vault has within a latched plurality of barrier arms that may be raised by any powered means, or manually, and raised barrier arms are positioned within the vault so that impact forces are transmitted directly to the vault and to a foundation, and little or no load is supported by a pivoting mechanism. The raised barrier arms have a hook on the end so that the speeding vehicle attacking the barrier will be snagged and prevented from inadvertently or intentionally vaulting the barrier.

U.S. Pat. No. 5,248,215 issued, Sep. 28, 1993, to M. Fladung entitled ROAD BARRICADE. This patent discloses a car park barricade that is fastened to the road surface with a barricade element optionally positioned parallel to the road surface or in a position at an angle thereto. The barricade element is swiveled upwards about an axis parallel to the road surface and vertical to the blocking direction by means of a drive mechanism comprising a spindle element.

U.S. Pat. No. 6,702,512 B1, issued Mar. 9, 2004 to G. S. Reale entitled VEHICLE ARRESTING INSTALLATION. This patent discloses a barrier for blocking the passage of a vehicle wherein the barrier has a bollard post positioned to obstruct a vehicle path. The post is coupled to piercing bars or pikes that are normally kept in a compact stand-by state in a recessed housing bordering the vehicle path. The bars deploy pivotally when the vehicle strikes and pivots back the post. The bars or pikes impale the body of the vehicle and break away in an assembly together with the barrier post, to interfere with continued or powered driving of the vehicle.

U.S. Pat. No. 6,997,638 B2, issued Feb. 14, 2006 to C. J. Hensley, et al entitled ANTI-TERRORIST ROAD BLOCK. This patent discloses a road block having an extendible bollard that is manually or electronically actuated by a powerful spring force for slow extension, and by both the spring and a power lift for rapid expansion.

U.S. Pat. No. 7,118,304 B2, issued Oct. 10, 2006 to R. R. Turpin and Joey W. Blair (the inventor hereof) entitled AUTOMATIC SELF CONTAINED COLLAPSIBLE TRAFFIC BARRIER BOLLARD SYSTEM. This patent discloses a collapsible traffic barrier located in a steel vault. A rod is rotatably mounted to support members inside the vault, wherein the rod extends across the vault from end to end. A plurality of bollards are secured to the rod near the first end thereof, whereby rotation of the rod rotates the bollards upward at an angle above the roadway and into the direction of an oncoming vehicle.

U.S. Pat. No. 7,641,416 B2, issued Jan. 5, 2010 to G. D. Miracle entitled VEHICLE BARRIER DEPLOYMENT SYSTEM. This patent discloses a system having at least two lifting members, at least one barrier member, and an actuation assembly. The lifting members are pivotally secured to a base member, and are operable to be selectively raised and lowered in a vertical direction relative to the base member. The barrier member is in communication with the lifting members, and is configured to stop a moving vehicle when the lifting members are in a raised position. The actuation assembly is in communication with lifting members, and is operable to selectively raise and lower the lifting members by moving at least a portion of each of the lifting members in a direction transverse to the traffic lane.

All of the prior art devices suffer from one or more disadvantages that are overcome by the system and structure of the present invention disclosed hereinbelow. Most of the prior art devices discussed above will only stop vehicles going in one direction, unlike the system of the present invention. As a result of the structure of the present invention vehicles may be stopped in multi directions, especially both directions in a single roadway. Moreover, many of the prior art devices require a lubricant or hydraulic fluid to operate, which creates environmental problems.

BRIEF DESCRIPTION OF THE DRAWINGS

The invention is explained in the following description in view of the drawings that show.

DETAILED DESCRIPTION OF THE INVENTION

The present invention is a pop-up bollard barrier system that is to be used for restricting physical access to high security areas wherein the highest level of protection is required. The system must be capable of stopping a 15,000 pound vehicle traveling at 50 mph. Vehicle barriers of this type are currently being used in areas around the world, but they are typically incapable of mechanically functioning reliably during an extended period of time. Other systems of this type are known for their complexity and are expensive to maintain, plus they are very expensive to install.

The present invention eliminates the need for high maintenance costs, high installation costs, and mitigates environmental issues related to lubricants and hydraulic oils typically used in such devices. Moreover, the present invention provides an inexpensive way to build and operate such a pop-up bollard barrier system.

Figure 1:
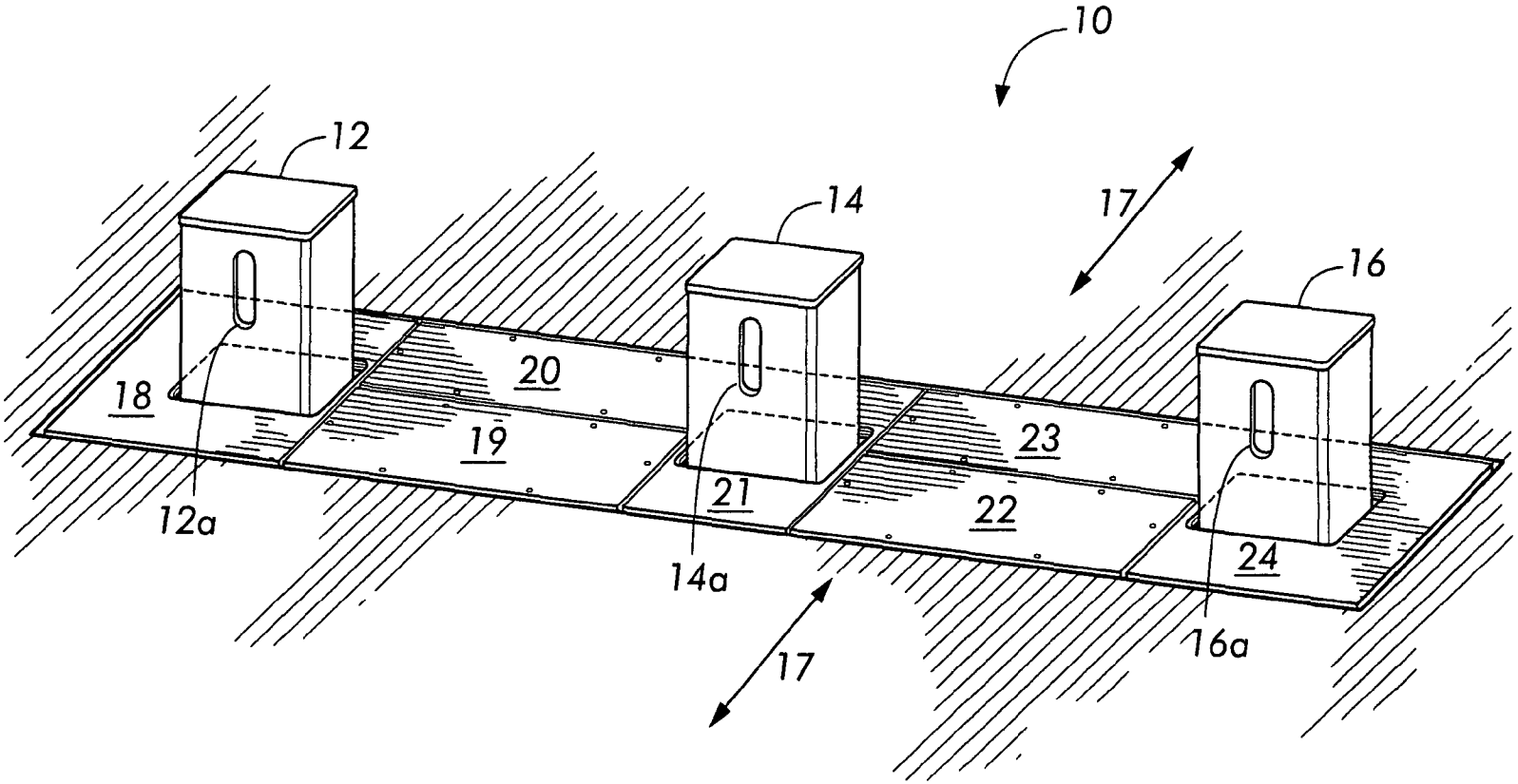
FIG. 1 is a perspective view of the system of the present invention wherein at least three bollards are in a partially raised position.

Referring now to the drawings and to FIG. 1 in particular, a perspective view of the system 10 of the present invention illustrates at least three bollards 12, 14 and 16 in a partially raised position. The system 10 includes a bollard assembly 11, which will be illustrated in FIGS. 2A, 2B and 2C and amplified further hereinafter; and, a vault 44 for receiving the bollard assembly 11, which will be illustrated in FIGS. 3 and 4 and also amplified further hereinafter. In accordance with one embodiment, the bollards are formed of three 12"×12"×½" steel tubes and upon activation they rise and extend from within the bollard assembly 11 secured within the vault 44 that is buried in the ground, and then project 36" vertically into the roadway 17 of vehicles when access is not approved. The vault 44 is surrounded by concrete reinforced to 3000 PSI and merges with the roadway 17. Each of the bollards 12, 14, 16, has affixed thereto a reflector 12A, 14A and 16A, respectively. The bollard assembly 11 is covered by a series of removable steel plates 18 through 25.

Figure 2A:
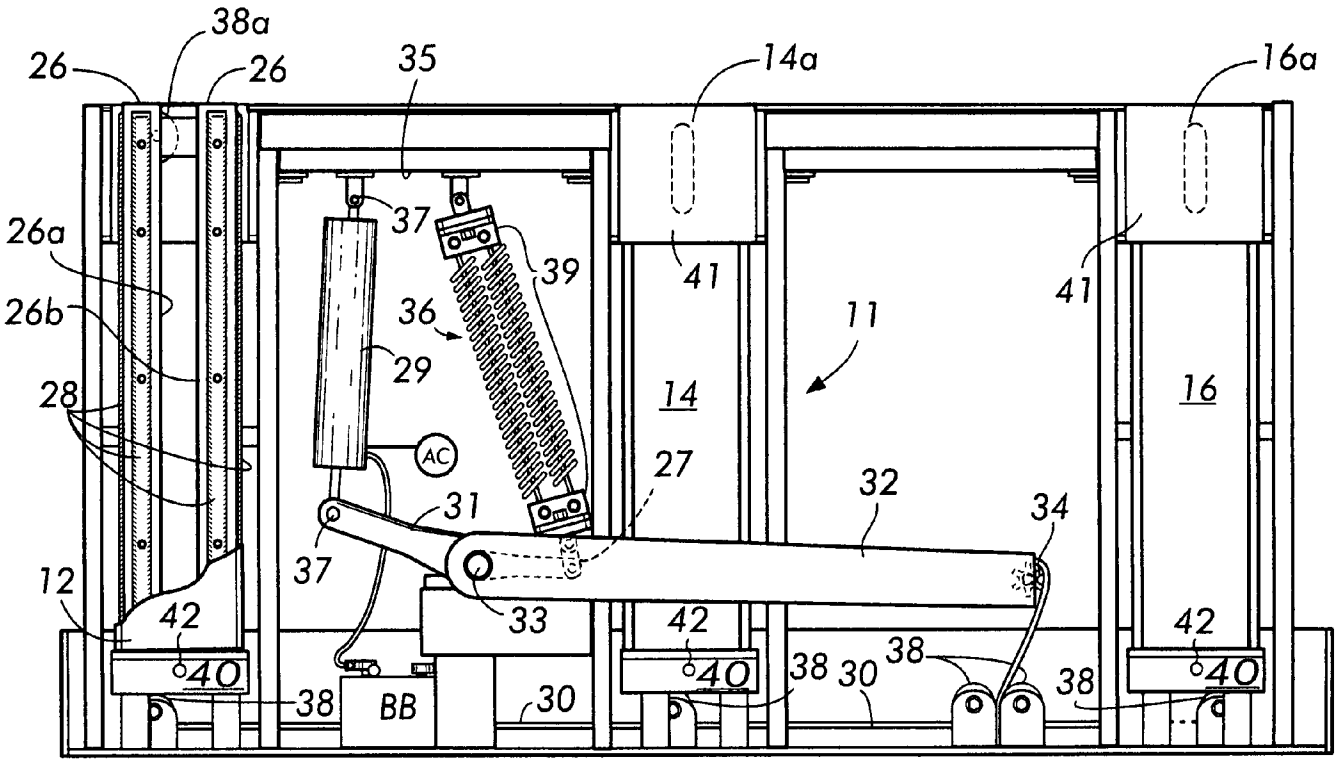
FIG. 2A is a partially cut-away elevational view of the bollard assembly of the present invention wherein the bollards are in the fully recessed position.
Figure 2B:
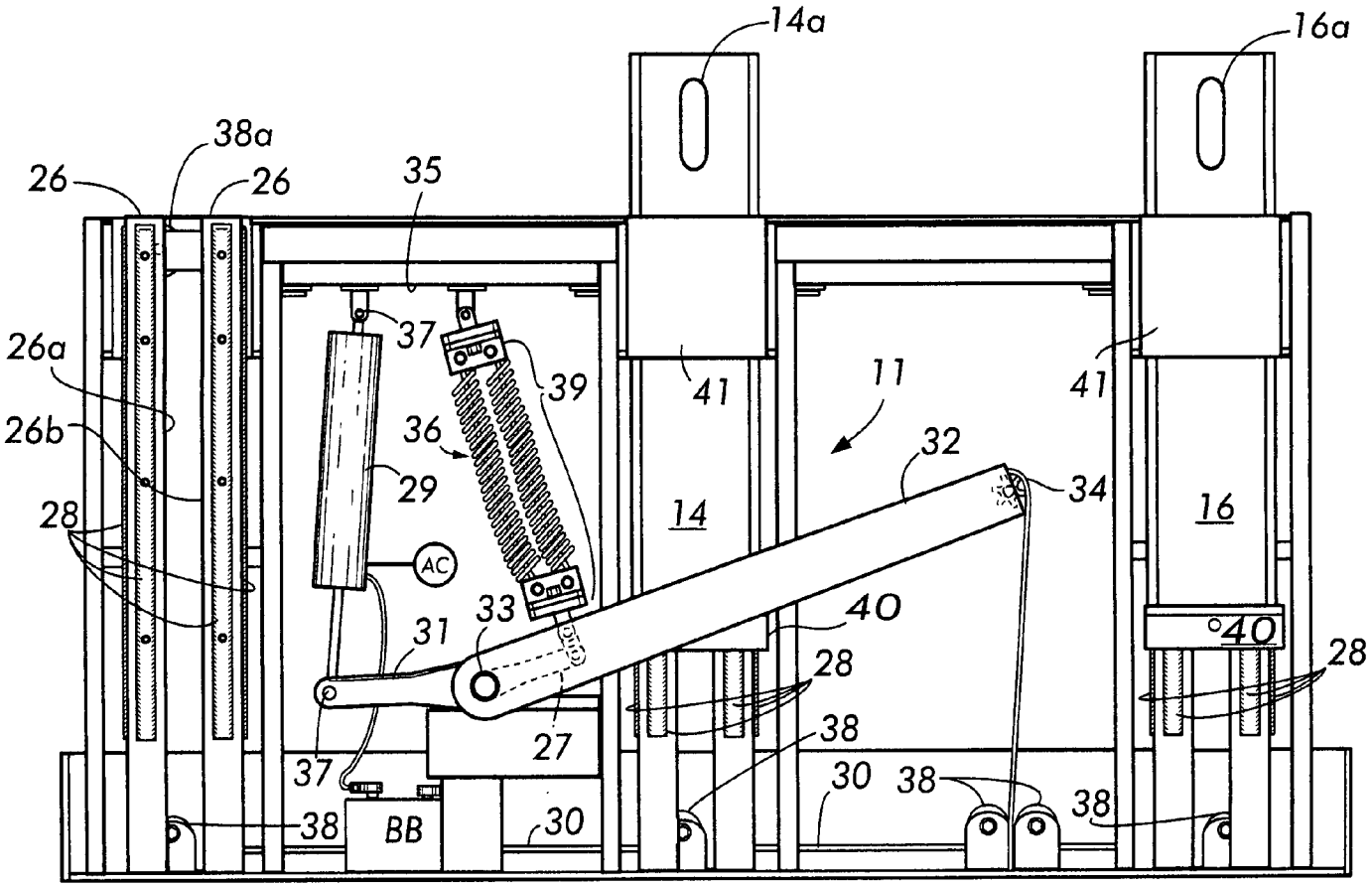
FIG. 2B is a partially cut-away elevational view of the bollard assembly of the present invention wherein the bollards are in a partially raised position.
Figure 2C:
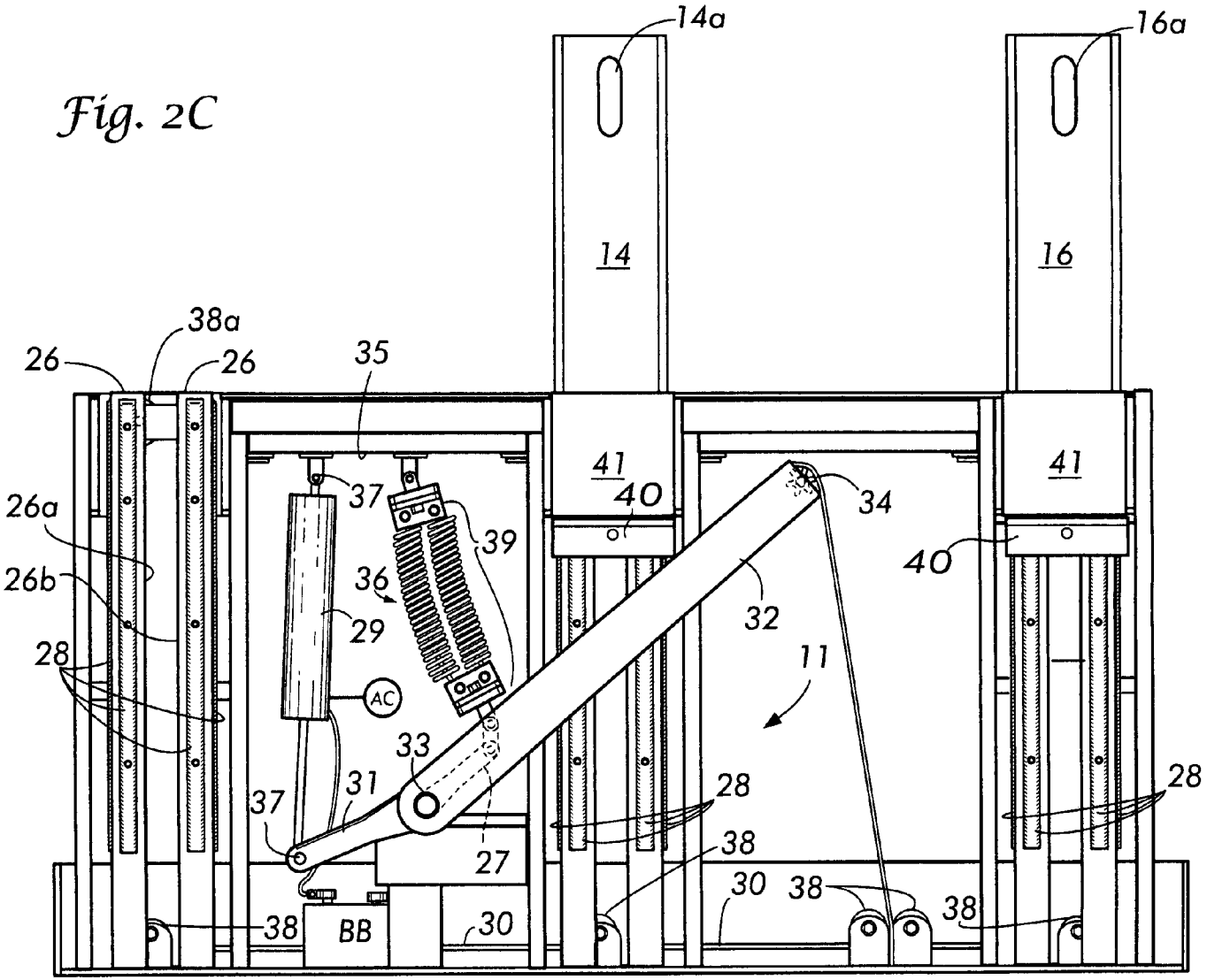
FIG. 2C is a partially cut-away elevational view of the bollard assembly of the present invention wherein the bollards are in the fully raised position.

With reference now to FIG. 2A the first of a series of partially cut-away elevational views of the bollard assembly 11 is shown to include the bollards 12, 14 and 16 in a sequence of movements from a fully recessed position (FIG. 2A) to a partially elevated position (FIG. 2B) to a fully deployed position (FIG. 2C). Again with reference to FIG. 2A, the bollard 12 is removed in order to show bollard post 26, which acts as a guide for the bollard 12 to rise and fall. Bollard guide post 26 comprises two pieces of channel steel 26A and 26B, which is illustrated in greater detail in FIGS. 4 and 6 and discussed hereinbelow. Strips 28 are made of a material known in the industry as Delrin (which is an engineered thermoplastic product available from DuPont Corporation) and the strips are attached to and spaced about the sides of the post 26. These strips provide a smooth surface for the bollards to glide over with a minimum of friction since the Delrin thermoplastic has a very low coefficient of friction. Accordingly, no lubricant is required between the guide posts 26 and the individual bollards 12, 14 and 16.

The bollard assembly 11 is operated with a single drive mechanism in the form of an electromechanical actuator 29 that powers the three bollards to the up and down position simultaneously. In accordance with one embodiment, one end of the actuator 29 is coupled to a pivot arm 31 and the other end thereof is coupled to frame 35 of the assembly 11. The pivot arm 31 is coupled to a single fulcrum 32 through a common shaft 33. The belt 30 (which actually comprises several belts operating in parallel) is connected to an end of the fulcrum opposite the common shaft 33, and a series of ratchets 34, which are coupled to the ends of the belts 30 at the end of the fulcrum 32, are used to tighten the belts. The ratchets 34 are standard off-the-shelf components and will not be amplified further herein. The belts 30 are guided around a series of pulleys 38 and 38A in order to raise each individual bollard 12, 14, 16. The actuator 29 operates the fulcrum 32 with the assistance of a group of springs 36 attached between the frame 35 and a pivot arm 27 coupled to the common central shaft 33. The pivot arm 27 in one embodiment is actually an extension of the pivot arm 31. That is, they comprise opposite ends of a single member pivoting about the central shaft 33.

The springs 36 may comprise any group of springs necessary to assist the lifting capability of the electromechanical actuator 29. The fulcrum design takes into consideration the need for the electromechanical actuator 29 to operate as a single drive for the three individual bollards 12, 14, and 16, and with the assistance of the spring system 36. The spring system 36 is designed to assist from the down position to the full up position of the bollards. The actuator 29 and the spring system 36 are connected to the structure using pins and devises 37 and 39, respectively, thereby allowing for free movement of motion required to deploy the bollards. In one embodiment, the actuator 29 has a 12" stroke, or extension, but is capable of moving the bollards to full deployment (36") based on the length of the pivot arm 31.

The actuator 29 is operated from a source of 208 single phase alternating current (AC), when activated by a signal to the AC source. Alternatively, there is a back-up battery BB if the source of AC should fail. One terminal of the battery BB is coupled to the actuator 29 and the other terminal is connected to the frame 35. Circuitry for operation of the actuator 29 is conventional in nature and will not be amplified further herein.

The bollard assembly is different from others on the market in that square tubing is employed, which offers a much more robust product with higher structural capabilities requiring less material. The use of this product allows for more safety signage (such as reflectors 12A, 14A and 16A) as well as less demand on the steel industry, thereby adding a savings not only to the "GREEN" concept but to cost savings for the end user as well. The bollard works over a double channel guide post 26 that will allow the bollard to slide up and down providing support and guidance for deployment. The Delrin product 28 acts as a slide attached to the guide post 26 to allow for smooth and controlled deployment of the bollards. This offers a stable position of the bollard while being deployed without the requirement of maintenance for metal products that would normally abrade and wear due to friction.

Figure 5:
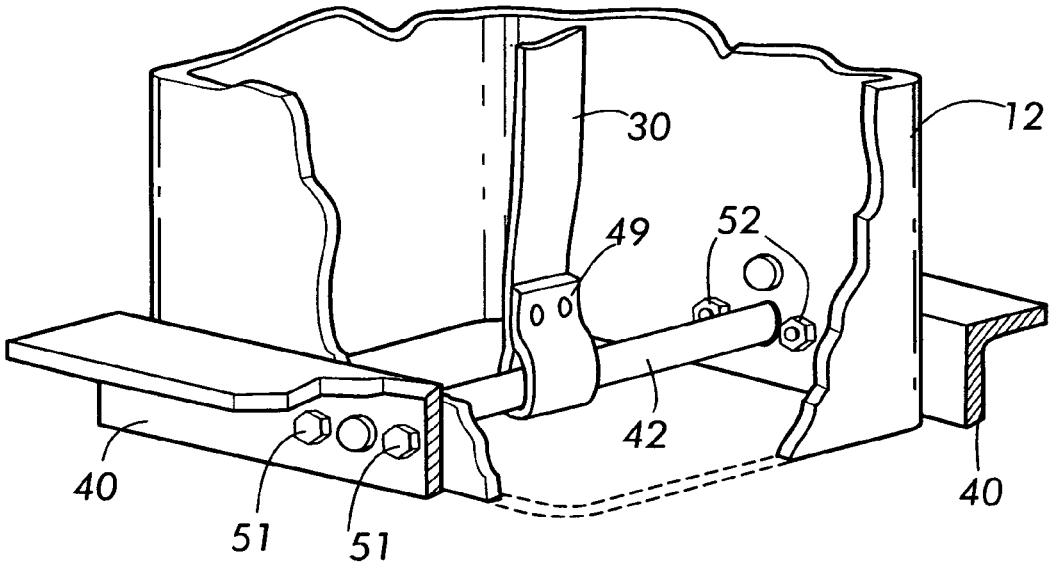
FIG. 5 is an isometric view of a detail of the actuating belt clasped to a pin secured to the bottom of a bollard.
Figure 6:
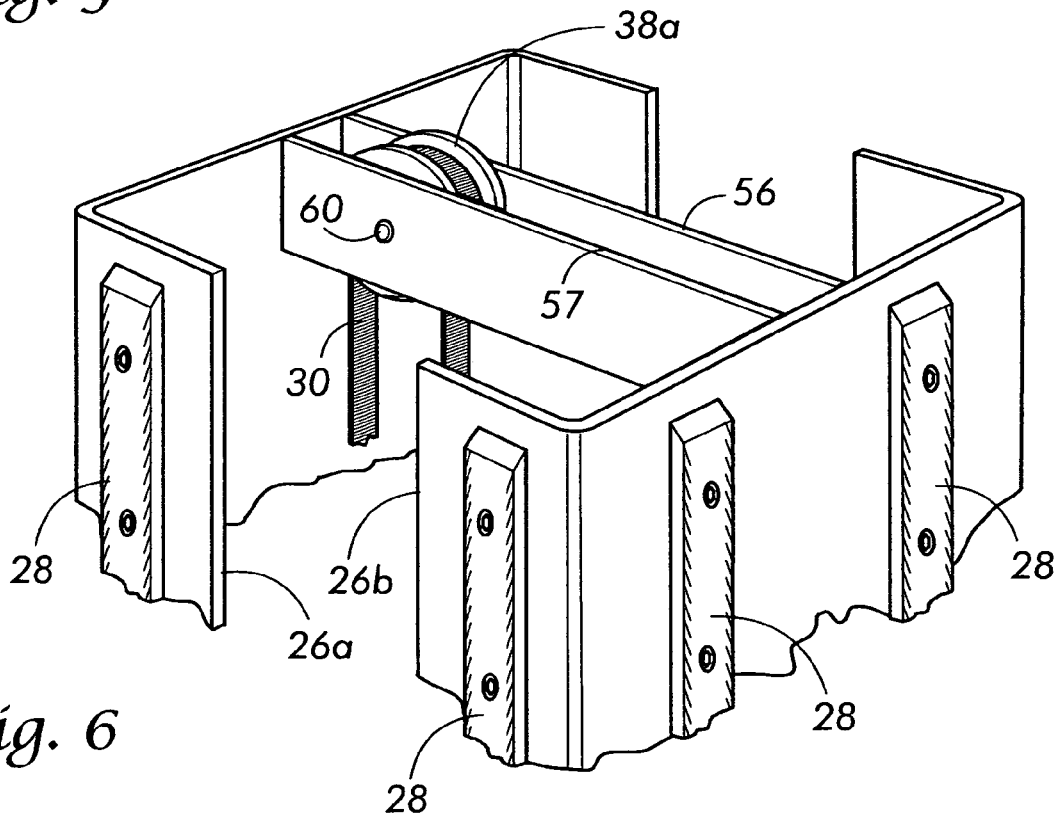
FIG. 6 is an isometric view of a detail of the top of a bollard post showing the pulley for the actuating belt.

In accordance with one embodiment, two pieces of 3"×3"×½" angle iron form a collar 40 that are fastened to two sides of the bottom of the bollards with four ¾"×4" bolts 51 (not shown in this FIG., but illustrated in greater detail in FIG. 5). The belt 30 runs around the pulley 38 then up through the tower 26 to another pulley 38A at the top of the tower and back down to a loop 49 on one end of the belt, which attaches to a 1 ½" pin 42. The pin 42 extends through the middle of the bollards 12, 14, and 16 at the bottom thereof. Each bollard is individually connected to the fulcrum 32 by the use of a loop in the belt 30, attached to the 1½" pin 42, then through a pulley configuration (38, 38A) to the ratchet 34 used for final adjustment for the tension of the belt 30. This arrangement is illustrated in FIGS. 5 and 6, and amplified further hereinafter.

The collar 40 acts as a stop for the bollard post on impact with a vehicle and for security of maintaining the bollard in position at all times. The bollard rests on the collar 40, which acts as a leveling stop for the final up position of the bollards 12, 14, 16. Upon impact of the barrier system, if a bollard is damaged, it can simply be unbolted, whereupon maintenance personnel can remove the bollard pin 42 and then remove the bollard itself for replacement. The lifting belt can then be reconnected to the 1½" pin 42, thereby allowing the product to be quickly put back into operation after a crash. The collar 40 along with the bolts 51 and the 1½" pin 42 on each side of the bollard prevents the bollard post from being removed by vandals as well as prevents the bollard from being pulled apart from the barrier system upon impact by an errant vehicle.

The bollard assembly 11 of the present invention employs connection joints encased in an engineered thermoplastic product similar to Delrin, which is available from DuPont Corporation. Use of this product for the connection joints eliminates the need for lubrication of the moving parts, which would normally wear and require lubrication. This addition helps improve the "GREEN" concept thereby eliminating yet another possibility for an environmental issue.

In accordance with one embodiment, a belt drive was used to allow for a "no" maintenance, flexible, quiet and long lasting system. Cables, chains and other products were considered but the belts 30 turned out to be the most practical for this application. In accordance with one embodiment, the belts 30 are made of Dyneema, which is an ultra-high-molecular-weight polyethylene. The belts 30 are ⅛" thick and 1" wide and have a tensile strength of approximately 7,000 pounds. The lifting requirement is calculated to be 350 pounds thereby allowing for a huge safety margin. The 4 inch pulleys 38, 38A for the belt application are a manufactured product that is made for up to 1¼" wide belt with a brass bushing, and steel with powder coat paint.

Figure 3:
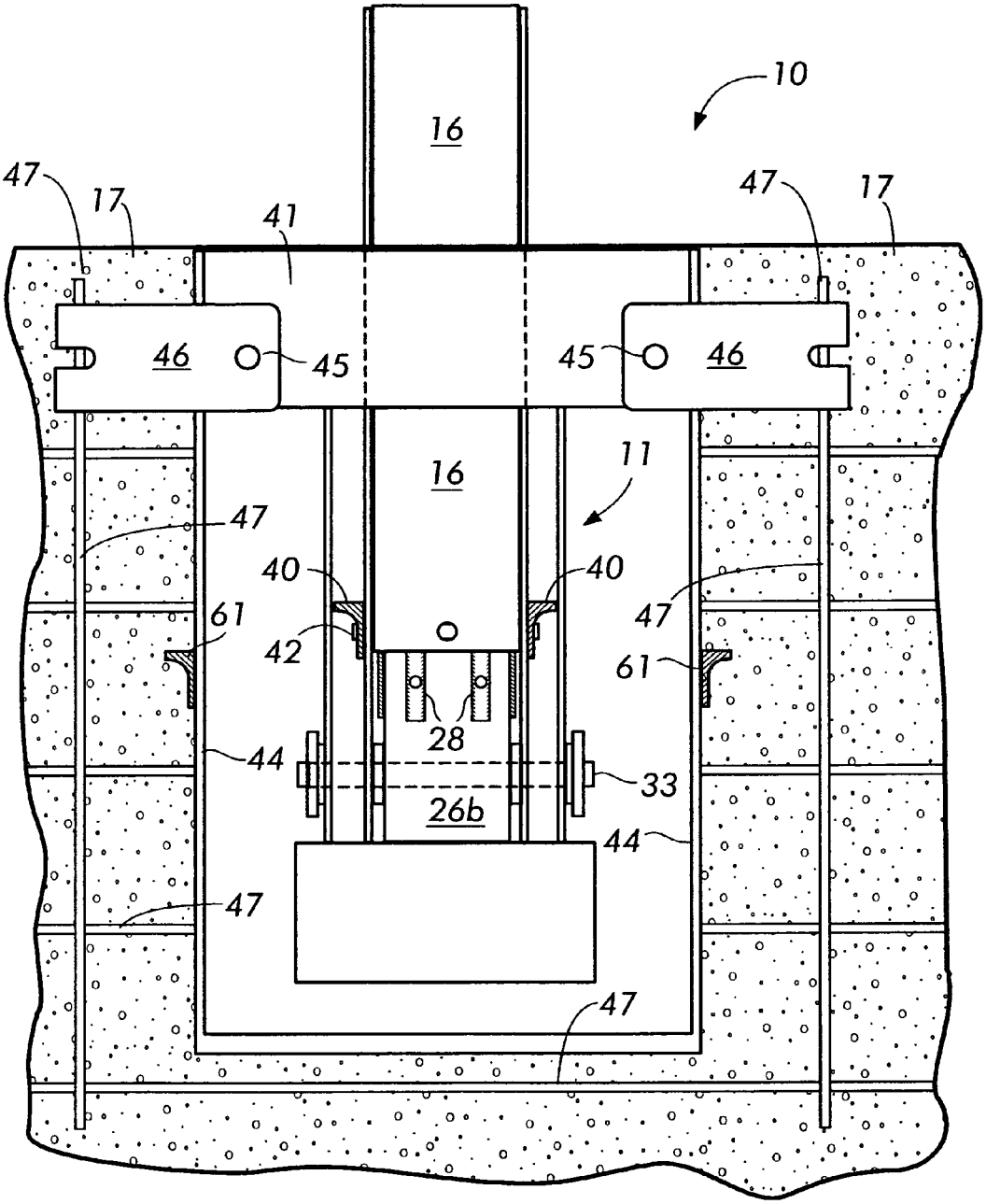
FIG. 3 is a cut-away view of an end of the bollard assembly of the present invention with a bollard in a partially raised position while being enclosed within a vault buried in the roadway.

As stated hereinabove, the present invention is built in two components, the bollard assembly 11, and a vault 44 buried in the roadway 17. With reference to FIG. 3, a cut-away view illustrates the end of the bollard assembly 11 inside the vault 44, with bollard 16 in a partially raised position. The bollard assembly 11 is made to lock into the vault 44 by means of pins 45 secured into 6"×12"×1" double steel extension clamps 46 anchored in the concrete and attached to the walls of the vault 44. The clamps 46 are also welded to a No. 5 re-bar cage 47 that extends nine inches from the sidewalls and six inches from the bottom of the vault 44. In accordance with one embodiment, the vault 44 is sized to be 10'×3'×54" and is constructed of ¼" plate steel on the sides with a 1½" plate steel on the bottom. The vault 44 is reinforced with 3"×3"×¼" angle iron 61, which acts as an added keyway to lock the vault 44 into the concrete. The re-bar cage 47 is separated on 12" centers and encases the vault on both sides and extends 6" on each end and extending to within 6" from the compacted soil on the bottom. The re-bar cage 47 will serve to tie the 18"×54" concrete foundation on both sides and the 12"×54" concrete foundation to the extension arms that are pinned to the bollard assembly 11, thereby anchoring the entire vault 44 and bollard assembly 11 together to absorb and hold the impact of a crash of 1,250,000 pounds of Kinetic energy resulting from the 50 mph crash.

Figure 4:
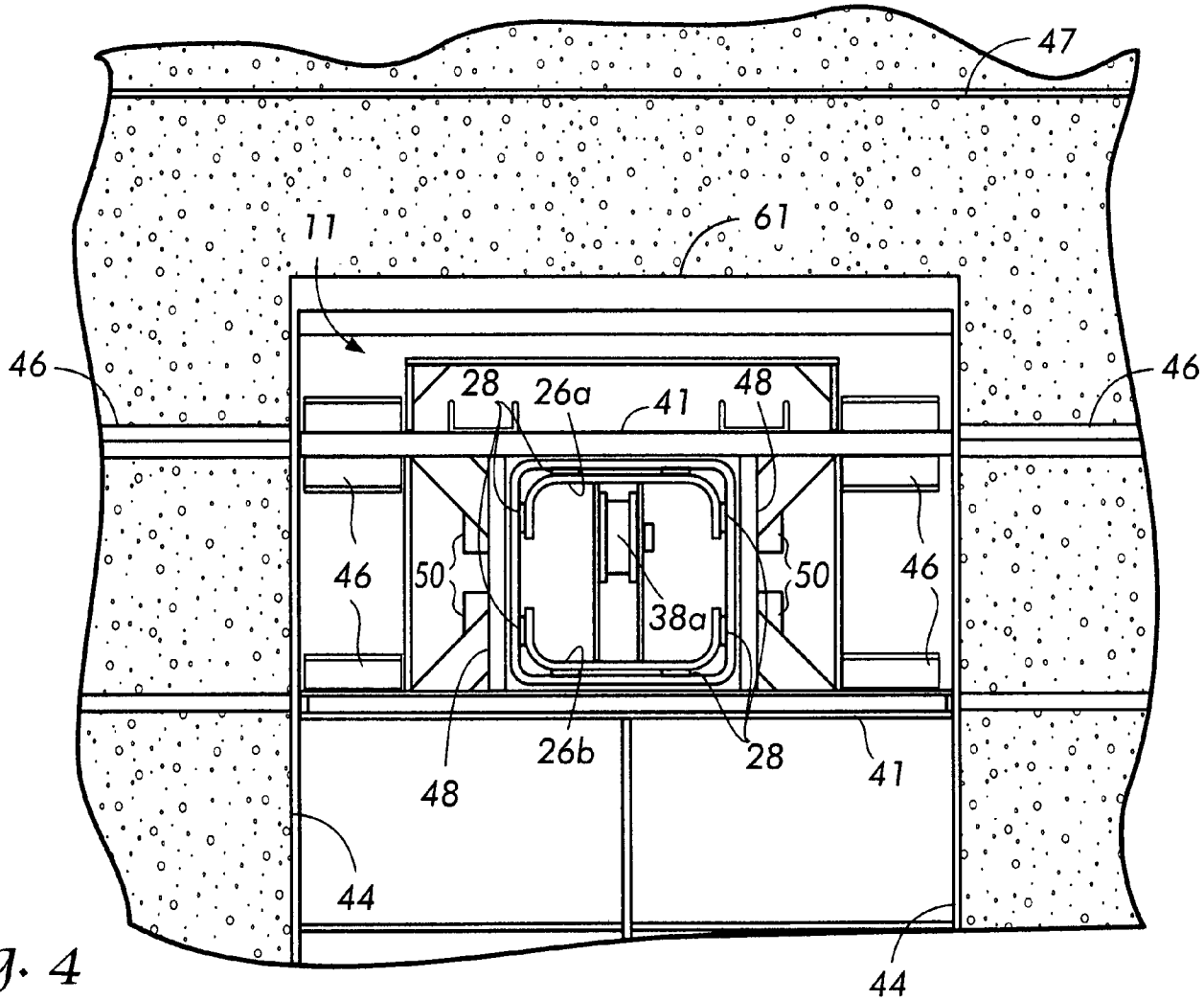
FIG. 4 is a top view of a single bollard of the bollard assembly within the vault, wherein some of the top covers have been removed.

Again with reference to FIG. 3, the shoulder 41 is made of 1"×12"×36" steel that runs astride the entire bollard assembly 11 and to the walls on either side of the vault 44. The shoulder 41 includes 1½" openings in each end for receipt of the pin 45 that secures the bollard assembly 11 into the vault at the clamps 46. With reference now to FIG. 4, a top view of an end of the bollard assembly 11 secured within the vault 44 is shown. Cross-brace members 48 are welded between the shoulders 41 in order to completely surround each of the bollards, and in particular bollard 16 in FIG. 4. Corner braces 50 are welded in each of four corners formed by the intersection of the shoulders 41 and the cross-brace members 48. This adds rigidity to the surrounds for the bollards 12, 14 and 16.

Referring now to FIG. 5, an isometric view of a detail of the belt 30 clasped to the pin 42 via a loop 49, which pin is secured to the bottom of the bollard 12. The collar 40 is shown attached to either side of the bollard 12, at the bottom thereof, by means of bolts 51 and nuts 52. As stated hereinabove, the collars act both as a stop for the bollard's upward travel, but also prevents removal of the bollard by vandals or the like. It may also be appreciated that removal of the collars 40 can be accomplished by removal of the nuts 52 and the bolts 51. The pin 42 may be slipped through the loop 49 in the belt 30 and through the vias on either side of the bottom of the bollard 12.

Referring now to FIG. 6 an isometric view of a detail of the top of a bollard post 26A, 26B showing the pulley 38*a* for the belt 30. The Delrin strips 28 are shown spread about the sides of the bollard post 26A, 26B, which form a smooth surface for the bollard post 12 to slide up and down upon. It is pointed out that the bollard 12 (shown in FIG. 5) slides over the bollard post 26. A pair of steel plates 56 and 57 is welded between the tops of the bollard posts 26A and 26B for support thereof and for supporting the pulley 38A by means of a pin 60.

The present invention employs a two-part system with the vault 44 and the bollard assembly 11 as an insert, which will dramatically ease the production and maintenance of the system once installed. The system 10 incorporates a mechanism to operate multiple bollard posts simultaneously with one motor, thereby dramatically lowering the cost of the system and maintenance thereof once installed. The design of the system 10 allows one to remove the bollard assembly 11 from the vault 44, which is secured in a permanent foundation, and still have the ability to reattach the bollard assembly 11 or a replacement assembly. All of this includes the ability to stop a 15,000 pound truck traveling at 50 mph, creating 1,250,000 pounds of kinetic energy. Upon impact, a maintenance crew will have the ability to simply remove and replace only the damaged bollard if required, while leaving the vault and bollard assembly 11 in a condition that would allow for continued use after minor repairs are made, if necessary.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

CATALOG OF PARTS

AC Source of alternating current
BB Backup Battery
10 System of the present invention
11 Bollard Assembly
12, 14, 16 Bollards
12A, 14A, 16A Reflectors of the bollards
17 Roadway

18 through 25 Top cover plates for the system 10
26 Bollard post for guiding movement of the bollards
26A, 26B Channel steel forming the bollard posts
27 Pivot arm for springs 36
28 Delrin strips for bollard posts 26
29 Electromechanical actuator
30 Belt
31 Pivot arm for actuator 29
32 Fulcrum to lift belts 30
33 Common shaft for fulcrum 32 and pivot 31
34 Ratchets for tightening belts 30
35 Frame for system 10
36 Group of springs to assist operation of actuator 29
37 Clevises for either end of the actuator 29
38, 38A Pulleys for belt 30
39 Clevises for either end of the spring system 36
40 Collar to limit upward movement of the bollards
41 Shoulder attached astride the system 10 on either side of the bollards
42 Pin for attaching belt to bollards
44 Vault buried in the roadway 17 for receiving the system 10
45 Pins to lock system 10 in the vault 44
46 Steel clamps embedded in concrete for securing system 10 in vault 44
47 Re-bar cage surrounding the vault 44 and for embedding in concrete
48 Cross-brace members
49 Loop in belt 30 for receiving the pin 42
50 Corner braces
51 Bolts for securing collar 40 to bottom of bollards
52 Nuts for the bolts 51
56 Steel plate supporting one side of the pulley 38A
57 Steel plate supporting other side of the pulley 38A
60 Pin for pulley 38A at the top of the bollards
61 Angle iron reinforcement of exterior of the vault 44

I claim:

1. A self-contained automatic pop-up bollard system for selectively barricading a roadway, said system comprising:
a. a vault having a steel lining and a reinforced steel cage surrounding said vault, and adapted to be embedded in concrete in said roadway; and,
b. a bollard assembly including:
i) at least one bollard slidably mounted over a bollard post disposed for supporting and guiding said bollard in vertical movement;
ii) a lifting mechanism having a belt disposed around pulleys, a pair of which are disposed at the bottom and top of said bollard post; and,
iii) a fulcrum pivotally mounted about a central shaft and having coupled to one end thereof a drive mechanism and on the opposite end thereof a first end of said belt and a second end of said belt affixed to the bottom of said at least one bollard after passing around said pulleys at the bottom and top of said bollard post, whereby movement of said drive mechanism raises said fulcrum thereby pulling on said belt and thus lifting said at least one bollard.

2. A system as in claim 1 wherein said bollard posts have affixed to surfaces thereof strips of a thermoplastic material having a low coefficient of friction, whereby movement of said bollards over said posts generate minimum friction, thereby eliminating the need for lubrication.

3. The system as in claim 2 wherein said strips of thermoplastic comprise Delrin.

4. The system as in claim 1 wherein said drive mechanism in an electromechanical actuator.

5. The system as in claim 1 wherein a spring assembly is coupled between the frame of said bollard assembly and a pivot arm coupled to said fulcrum in order to assist in movement thereof.

6. The system as in claim 1 wherein said at least one bollard includes a collar affixed to the bottom thereof in order to limit the upper movement of said at least one bollard.

7. The system as in claim 1 further including clamps attached to walls of said vault and embedded in said concrete, said clamps being adapted for receiving ends of shoulder members affixed astride said bollard assembly, each of said clamps and said ends of said shoulder members having a hole therein for receiving a pin for securing said bollard assembly in said vault, whereby said bollard assembly may be replaced with another bollard assembly without removal of said vault.

8. A self-contained automatic pop-up bollard system for selectively barricading a roadway, said system comprising:
a. a vault having a steel lining and a reinforced steel cage surrounding said vault, and adapted to be embedded in concrete in said roadway; and,
b. a bollard assembly including:
i) at least one bollard slidably mounted over a bollard post disposed for supporting and guiding said bollard in vertical movement;
ii) a lifting mechanism having a belt disposed around pulleys, a pair of which are disposed at the bottom and top of said bollard post;
iii) a fulcrum pivotally mounted about a central shaft and having coupled to one end thereof a drive mechanism and on the opposite end thereof a first end of said belt and a second end of said belt affixed to the bottom of said at least one bollard after passing around said pulleys at the bottom and top of said bollard post, whereby movement of said drive mechanism raises said fulcrum thereby pulling on said belt and thus lifting said at least one bollard; and,
iv) clamps attached to walls of said vault and embedded in said concrete, said clamps being adapted for receiving ends of shoulder members affixed astride said bollard assembly, each of said clamps and said ends of said shoulder members having a hole therein for receiving a pin for securing said bollard assembly in said vault, whereby said bollard assembly may be replaced with another without removal of said vault.

9. A system as in claim 8 wherein said bollard posts have affixed to surfaces thereof strips of a thermoplastic material having a low coefficient of friction, whereby movement of said bollards over said posts generate minimum friction, thereby eliminating the need for lubrication.

10. The system as in claim 9 wherein said strips of thermoplastic comprise Delrin.

11. The system as in claim 8 wherein said drive mechanism is an electromechanical actuator operable by alternating current and direct current from a backup battery in the event of a failure of said alternating current.

12. The system as in claim 8 wherein a spring assembly is coupled between the frame of said bollard assembly and a pivot arm coupled to said fulcrum in order to assist in movement thereof.

13. The system as in claim 1 wherein said at least one bollard includes a collar affixed to the bottom thereof in order to limit the upper movement of said at least one bollard.

14. A self-contained automatic pop-up bollard system for selectively barricading a roadway, said system comprising:
a. a vault having a steel lining and a reinforced steel cage surrounding said vault, and adapted to be embedded in concrete in said roadway; and, b. a bollard assembly including:

i) N bollards slidably mounted over N respective bollard posts disposed for supporting and guiding said bollards in vertical movement, said bollard posts having affixed to surfaces thereof strips of a thermoplastic material having a low coefficient of friction, whereby movement of said bollards over said posts generates minimum friction, thereby eliminating the need for lubrication;

ii) a lifting mechanism having a belt disposed around pulleys, a pair of which are disposed at the bottom and top of said bollard post;

iii) a fulcrum pivotally mounted about a central shaft and having affixed to one end thereof a drive mechanism and on the opposite end thereof a first end of said belt affixed thereto and a second end of said belt affixed to the bottom of each of said bollards after passing around said pulleys at the bottom and top of said bollard post, whereby movement of said drive mechanism raises said fulcrum thereby pulling on said belt and thus lifting said bollards; and, iv) clamps attached to walls of said vault and embedded in said concrete, said clamps being adapted for receiving ends of shoulder members affixed astride said bollard assembly, each of said clamps and said ends of said shoulder members having a hole therein for receiving a pin for securing said bollard assembly in said vault, whereby said bollard assembly may be replaced with another without removal of said vault.

15. The system as in claim 14 wherein said strips of thermoplastic comprise Delrin.

16. The system as in claim 14 wherein said drive mechanism is an electromechanical actuator operable by alternating current and direct current from a backup battery in the event of a failure of said alternating current.

17. The system as in claim 14 wherein a spring assembly is coupled between the frame of said bollard assembly and a pivot arm coupled to said fulcrum in order to assist in movement thereof.

18. The system as in claim 14 wherein connection joints of said bollard assembly are encased in thermoplastic bushings so as to reduce friction and obviate lubrication.

19. The system as in claim 14 wherein said belt is made of Dnyeema.

20. The system as in claim 14 wherein N is an integer having a value between one and three.

* * * * *